US010106988B1

(12) United States Patent
Stone

(10) Patent No.: US 10,106,988 B1
(45) Date of Patent: Oct. 23, 2018

(54) SELF ADHERENT FOAM BASED MOSAIC TILE

(71) Applicant: Norman Stone, Harrison, NY (US)

(72) Inventor: Norman Stone, Harrison, NY (US)

(73) Assignee: TOWER IPCO COMPANY LIMITED (IE)

( * ) Notice: Subject to any disclaimer, the term of this patent is extended or adjusted under 35 U.S.C. 154(b) by 0 days.

(21) Appl. No.: 15/712,392

(22) Filed: Sep. 22, 2017

(51) Int. Cl.

| | |
|---|---|
| ***E04F 15/02*** | (2006.01) |
| ***B44C 3/12*** | (2006.01) |
| ***E04F 13/07*** | (2006.01) |
| ***E04F 13/08*** | (2006.01) |
| ***E04F 13/077*** | (2006.01) |

(52) U.S. Cl.
CPC ..... *E04F 13/0873* (2013.01); *B44C 3/123* (2013.01); *E04F 13/077* (2013.01); *E04F 15/02044* (2013.01); *E04F 2015/02105* (2013.01)

(58) Field of Classification Search
CPC ..... E04F 13/0873; E04F 13/077; E04F 15/02044; E04F 2015/02105; B44C 3/123
See application file for complete search history.

(56) References Cited

U.S. PATENT DOCUMENTS 1,838,108 A * 12/1931 Rhodes ..... B44F 3/00 273/157 R
3,067,054 A * 12/1962 Reese ..... B32B 27/00 156/238
3,362,119 A * 1/1968 Murphy ..... E04C 2/284 428/49
3,666,606 A * 5/1972 stokes ..... E04F 13/0862 428/430
5,196,248 A * 3/1993 Danico ..... B44C 1/105 428/137
5,443,680 A * 8/1995 Gerber ..... B44L 39/00 156/362
5,643,669 A * 7/1997 Tsuei ..... B24D 3/28 428/354
2011/0126483 A1* 6/2011 Garcia Dorado ..... B44C 1/28 52/311.2
2011/0293873 A1* 12/2011 Riccobene ..... B44C 3/123 428/44
2015/0211236 A1* 7/2015 Bowden ..... E04F 13/0885 428/41.8
2015/0375471 A1* 12/2015 Song ..... B32B 37/182 428/159

FOREIGN PATENT DOCUMENTS

GB 1266981 A * 3/1972 ..... A47B 13/08

* cited by examiner

*Primary Examiner* — Jeanette E Chapman
(74) *Attorney, Agent, or Firm* — Rodman & Rodman LLP

(57) ABSTRACT

A mosaic tile member has a backing layer with a top adhesive surface for adhering at least two sets of individual tiles onto the backing layer in spaced relationship to permit grouting between the individual tiles. Each set of individual tiles has a foam base layer that is approximately 67 to 80 percent of the overall thickness of the mosaic tile. A design layer and a transparent protective wear layer cover the foam base layer. The design for one set of individual tiles can differ from the design for the other set of individual tiles. An adhesive is provided on the bottom of the backing layer to enable the mosaic tile to self-adhere to a wall, ceiling and floor surface. Individual tiles in the mosaic tile can be punched out or cut from a blank laminate of the foam base layer, the design layer and the protective wear layer.

18 Claims, 8 Drawing Sheets

Fig. 2
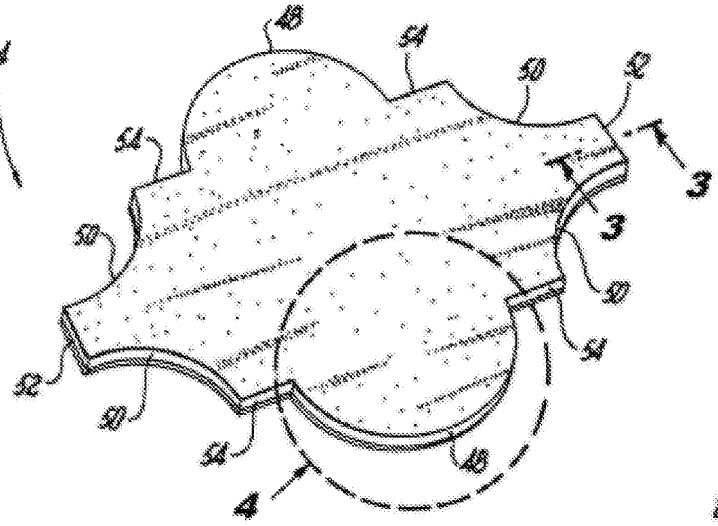
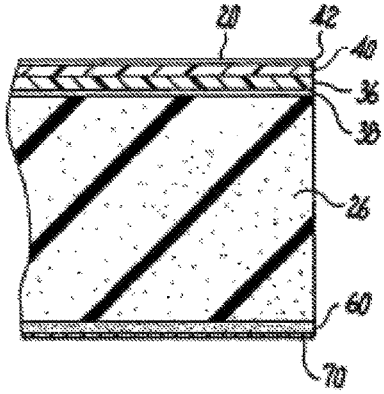
Fig. 3
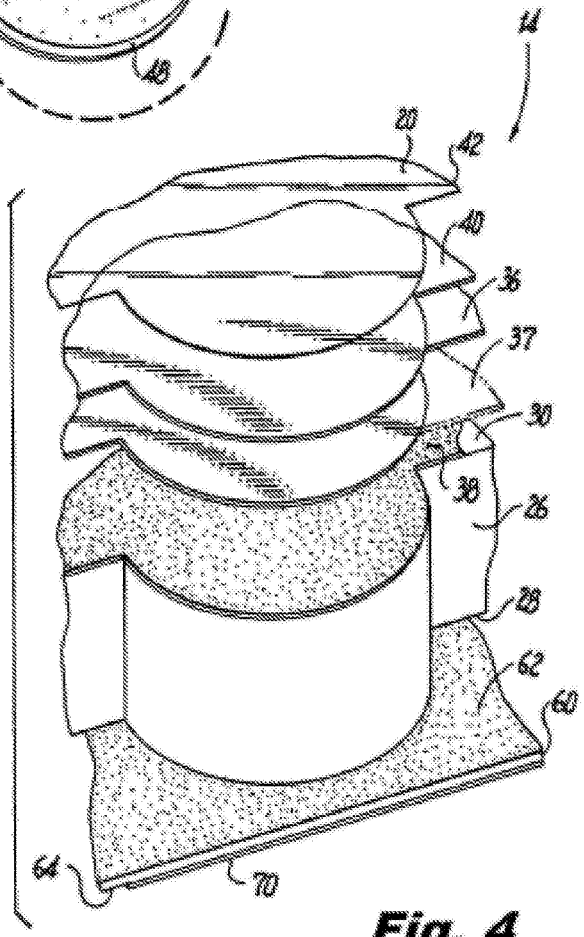
Fig. 4

16
14
10
16
10
92
14
16
10
14

SELF ADHERENT FOAM BASED MOSAIC TILE

BACKGROUND OF THE INVENTION

Field of the Invention

This invention is directed to a novel mosaic tile and more particularly to a novel laminated, self-adherent, foam based, mosaic tile that can be used as a ceiling tile, a wall tile, and a floor tile.

The novel mosaic tile can be directly adhered to a ceiling surface, a wall surface, and a floor surface with an adhesive that can be a self-stick contact adhesive pre-coated onto the back of the mosaic tile.

The novel mosaic tile is relatively inexpensive to manufacture, is lightweight and is essentially shatterproof. Furthermore, installation of the mosaic tile does not require special skills or training, thus enabling the mosaic tile to be attractive to do-it-yourself individuals who have had little or no previous experience installing tiles.

The invention is also directed to a method for preparing a mosaic tile for installation a ceiling surface, a wall surface and a floor surface.

DESCRIPTION OF DRAWINGS

In the accompanying drawings,

FIG. 2 is a simplified perspective view of an individual tile that is incorporated in the mosaic tile;

FIG. 3 is an enlarged fragmentary sectional view taken along the line 3-3 of FIG. 2.

FIG. 4 is an enlarged fragmentary exploded view of the tile portion bounded by the circle 4 in FIG. 2.

Corresponding reference numbers indicate corresponding parts throughout the several views of the drawings.

DETAILED DESCRIPTION OF INVENTION

Figure 1:
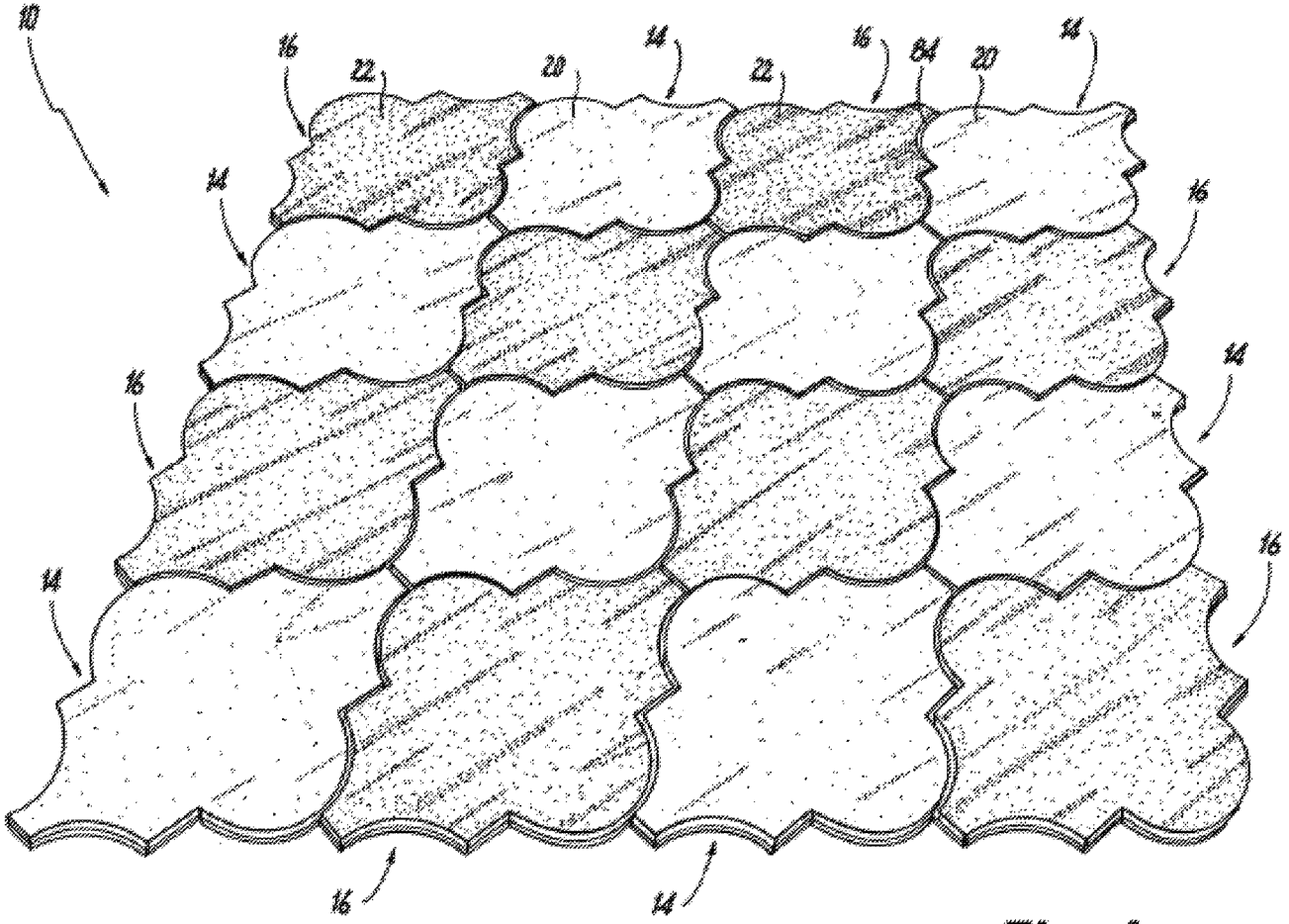
FIG. 1 is a simplified perspective view of a mosaic tile incorporating one embodiment of the present invention.

Referring to the drawings, a mosaic tile member incorporating one embodiment of the invention is generally indicated by the reference number 10 in FIG. 1.

The mosaic tile member 10 includes one set of individual tiles 14 and a second set of individual tiles 16.

Each of the tiles 14 in the first set of tiles have similar design appearances at a top surface 20 (FIG. 1) of the tile, and each of the tiles 16 in the second set of tiles have similar design appearances at a top surface 22 of the tile. However, the design appearance at the top surface 20 of the tiles 14 differs from the design appearance at the top surface 22 of the tiles 16. Thus, the set of individual tiles 14 and the set of individual tiles 16 are characterized by different designs.

The sets of individual tiles 14 and 16 are positioned in the mosaic tile member 10 in a predetermined pattern to provide the mosaic tile member 10 with a predetermined mosaic appearance such as shown in FIG. 1. Although the individual tiles 14 have a design appearance that is different from the design appearance of the individual tiles 16, each of the tiles 14 and 16 have the same peripheral shape and are structurally similar.

Since the tile 16 is structurally similar to the tile 14, the structural description of the tile 14 is also applicable to the tile 16, unless otherwise indicated.

The tile 14 has a foam base layer 26 (FIG. 4) formed of a closed cell polyfoam or foam plastic material. The foam base layer 26 has a lower surface 28 and an upper surface 30.

A design film layer 36 (FIGS. 3 and 4) formed of any suitable known plastic material, is adhered to the upper surface 30 of the foam base layer 26 with a suitable known adhesive 38 (FIG. 4), such as a polyurethane adhesive or by using other suitable known lamination techniques. If desired, as an alternative to using the design film layer 36, a design can be printed directly onto upper surface 30 of the foam base layer 26.

The design film layer 36 has any selected type of design pattern or decorative appearance, such as a ceramic glaze appearance, a mineral grain design resembling marble, granite or other natural stone, a wood grain design, a color pattern, a color blend, or a single color, to name just a few of the design possibilities.

However, the design on the design film layer 36 for all of the tiles 14 is substantially consistent, whereas the design on the design film layer 36 for all of the tiles 16 is substantially consistent but distinctly different from the design on the tiles 14.

The design film layer 36 is covered by a transparent or semi-transparent abrasion resistant wear layer 40 (FIG. 4), which can be formed of polyvinyl chloride and fabricated in a known manner. The wear layer 40 protects the design pattern on the design film layer 36.

The design film layer 36 and the wear layer 40 can be further protected with a known ceramic bead coating 42 (FIG. 4). The top of the ceramic bead coating 42 on the tile 14 is the top surface 20 of the tile 14. The tile 16 has a layered or laminate structure that is the same as the structure previously described for the tile 14. The top of the ceramic bead coating 42 on the tile 16 is the top surface 22 of the tile 16.

If the mosaic tile 10 is used as a floor tile, the wear layer 40 can be provided with suitable known relief or surface embossments (not shown) or any other known texturing treatment to enhance traction. Relief or surface embossments may also be desirable if the mosaic tile 10 is used as a wall or ceiling tile.

Figure 5:
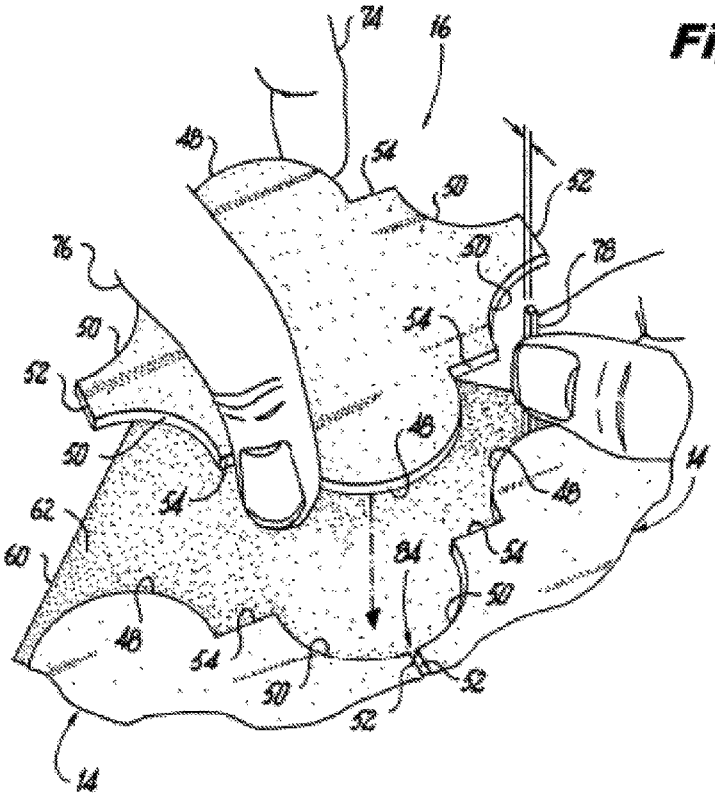
FIG. 5 is a simplified fragmentary perspective view showing an individual tile being placed onto a backing layer during assembly of the mosaic tile.

The tiles 14 (FIGS. 1 and 2) and the tiles 16 (FIG. 1) that are incorporated in the mosaic tile 10 have similar peripheral shapes. Referring to FIG. 5, the tile 14 includes a pair of opposite convex semi-circular portions 48, 48 and four concave circular quadrant portions 50, 50, 50, and 50. The tile 14 also includes a pair of opposite straight end portions 52, 52 that each intersect a pair of the circular quadrant portions 50, 50. The tile 14 further includes four straight side portions 54, 54, 54 and 54 that each intersect a circular quadrant 50 and a convex semi-circular portion 48.

The mosaic tile 10 as shown in FIG. 1 includes sixteen individual tiles, in a four by four array of tiles 14 and 16 in an alternating arrangement. The four by four array of individual tiles 14, 16 is a matter of choice. Other arrays are possible but not shown, such as two tiles by four tiles, three tiles by four tiles, five tiles by four tiles, five tiles by five tiles and so on. Furthermore, although the mosaic tile 10 has been described as having one set of tiles 14 and one set of tiles 16, the mosaic tile 10 can include more than two sets of different tile designs and each set need not have the same number of tiles.

The individual tiles 14 and 16 are assembled together on a backing layer 60 (FIGS. 5 and 6) to form the mosaic tile 10 of FIG. 1. The backing layer 60 (FIGS. 5 and 6) is initially slightly larger than the length and width of the finished mosaic tile 10 of FIG. 1, and is preferably made of a flexible, resilient foam sheet with double-sided adhesive. A preferred material for the backing layer 60 is ethylene vinyl acetate foam with double-sided pressure sensitive adhesive, such as the double-sided adhesive foam sold under the trade designation Essentra by Duraco of Forest Park, Ill.

The backing layer 60 has a top adhesive surface 62 (FIG. 4) and a bottom adhesive surface 64 having a self-stick adhesive. A removable release paper 70 (FIGS. 3 and 4) covers the bottom adhesive surface 64.

Figure 6:
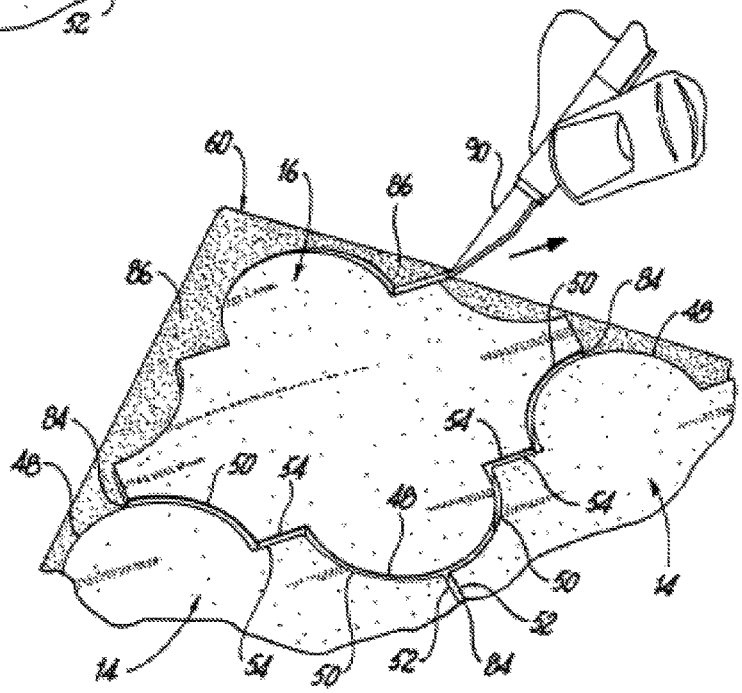
FIG. 6 is a simplified fragmentary perspective view showing the manner in which excess portions of the backing layer are removed during assembly of the mosaic tile.

The lower surface 28 (FIG. 4) of the foam base layer 26, which is also the lower surface of the individual tiles 14, 14, is adhered to the top adhesive surface 62 of the backing layer 60 (FIGS. 5 and 6). Location of an individual tile 16 on the backing layer 60 (FIG. 5) is accomplished, for example, by manual positioning of the tile 16. Thus, the tile 16 can be held above the backing layer 60 by fingers 74 and 76 before placement of the tile 16 onto the top adhesive surface 62. The tile 16 is then placed onto the backing layer 60 next to the already adhered tiles 14, 14 that were also manually positioned.

The positioning of the tile 16 next to the already adhered tiles 14, 14 (FIG. 5) is facilitated by using a suitable spacing device such as a shim 78 (FIG. 5). The shim 78 can be manually held and helps determine a grouting space 84 between the peripheries of adjacent tiles 14 and 16 on the backing layer 60 as shown in FIG. 6.

The tiles 16 and 14, 14 of FIGS. 5 and 6 are positioned such that a convex semi-circular portion 48 of the tile 16 (FIG. 5) is next to the circular quadrants 50, 50 of the two adjacent, previously positioned tiles 14, 14. The previously positioned tiles 14 and 14 are spaced at their respective straight end portions 52, 52 by the grout space 84. The straight sides 54, 54 of the tile 16 are also positioned adjacent to the straight sides 54, 54 of the respective tiles 14, 14 as shown in FIG. 6. In addition, the concave circular quadrants 50, 50 of the tile 16 are positioned next to the concave semi-circular portions 48, 48 of the tiles 14, 14. In this manner, each of the individual tiles 14 and 16 in the mosaic tile 10 can be placed on the backing layer 16 with the grouting space 84 provided between adjacent tiles 14 and 16.

After a full array of the tiles 14 and 16 are placed on the backing layer 60 in the four by four arrangement shown in FIG. 1, excess peripheral portions 86 of the backing layer 60 are trimmed away as shown in FIG. 6. For example, the excess peripheral portions 86 of the backing layer 60 are removed by a suitable cutting tool 90 (FIG. 6) such that the periphery of the backing layer 60 matches the periphery of the individual tiles 14 and 16 that have been secured next to each other on the backing layer 60 to form the mosaic tile 10.

Although the outer peripheral dimensions of the mosaic tile 10 are a matter choice, a suitable size can be, for example, 12 inches by 12 inches. Smaller or larger sizes are also a matter of choice.

Foam plastic materials suitable for forming the foam base layer 26 include polyurethane, polyamide copolymers, polystyrene, polyvinyl chloride (PVC), polypropylene, and polyethylene foamed plastics.

Foam plastic material contains hollow globules or air cells, which are preferably closed cells. The foam plastic material provides the mosaic tile 10 with reduced density and lighter weight in comparison with dimensionally similar non-foam plastic material.

Polyvinyl chloride (PVC) foam materials are especially suitable for forming the foam base layer 26 (FIG. 4) because they are chemically stable, corrosion resistant, and have excellent flame-retardant properties.

The foam base layer 26 of the tiles 14 and 16 is preferably an inflexible, generally rigid closed cell foam formed of PVC. One example of components of a PVC foam base layer 26 can comprise, in weight percent the following:

Plastic material 40 to 90%
Foaming agent 0.7 to 3%
Foam control agent 4 to 8%
Stabilizing agent 1.5 to 5%
Plasticizing agent 0 to 15%
Lubrication agent 1 to 2%
Heavy calcium 0 to 50%
Toughening agent 3 to 9%
Flame-retardant agent 3 to 15%
Antiseptic and anti-mildew agent 0.5 to 2%

The density of the foam base layer 26 can be approximately 0.6 to 1.2 grams per cubic centimeter. The foam base layer 26, the design film layer 36 and the wear layer 40 can be laminated together.

In one illustrative embodiment of the mosaic tile 10, the foam base layer 26 is formed of PVC of the type previously described, having a thickness of approximately 3.0 millimeters. The design film layer 36 has a thickness of approximately 0.3 millimeters and the wear layer 40 has a thickness of approximately 0.2 millimeters. The backing layer 60 has a thickness of approximately 1.0 millimeters. The total thickness of the mosaic tile 10 is thus approximately 4.5 millimeters.

Under this arrangement the foam base layer 26 constitutes approximately ⅔ or 67 percent of the overall thickness of the mosaic tile 10.

It has been found that a four by four arrangement of tiles 14 and 16 as shown in FIG. 1, that is 12 inches long by 12 inches wide and approximately 4.5 millimeters thick weighs approximately eight ounces. Thus, each individual tile 14, 16 in this example of the mosaic tile 10 weighs less than ½ ounce. The light-weight mosaic tile 10 with the self-adhesive bottom portion 64 is thus relatively easy to manipulate and install on walls, ceilings and floors.

If desired, the individual tiles 14 and 16 in the mosaic tile member 10 can have the same design.

In a second illustrative embodiment of the mosaic tile 10 that is preferably used on floors, the foam base layer 26 has a thickness of approximately 4 to 5 millimeters. The design film layer 36 has a thickness of approximately 0.1 millimeters and the wear layer 40 has a thickness of approximately 0.15 to 0.7 millimeters. The backing layer 60 has a thickness of approximately 1.0 millimeters. The wear layer 40 can be coated with a suitable known ultra violet protection coating such as a ceramic bead coating 42 (FIG. 4) having a thickness of approximately 0.07 millimeters.

An intermediate layer 37 (FIG. 4) formed of PVC and generally known as an LVT intermediate layer is preferably used on floor tiles and is provided between the foam base layer 26 and the design film layer 36. The intermediate layer 37 is a reinforcing layer, approximately 0.9 to 1.1 millimeters thick, and is used for enhancing the stiffness of the tile 10 when it is used as a floor tile. The total thickness of this embodiment of the mosaic tile 10 is approximately 6.22 to 7.97 millimeters.

Under this arrangement the foam base layer constitutes approximately 64 to 80 percent of the overall thickness of the tile 10.

Figure 7:
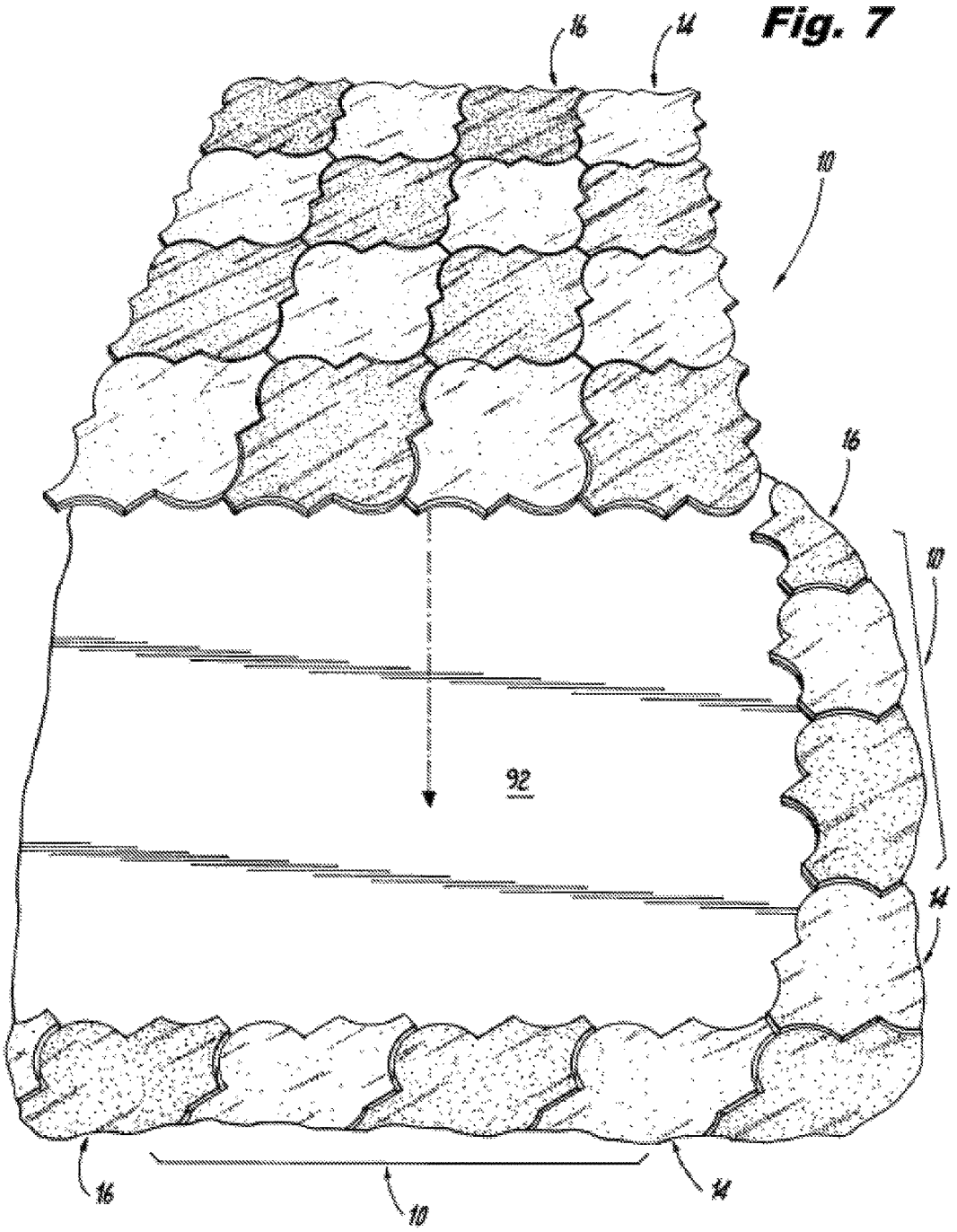
FIG. 7 is a simplified fragmentary perspective view showing the manner in which a mosaic tile is placed onto a surface adjacent to other similar mosaic tiles that have been previously adhered to the surface.
Figure 8:
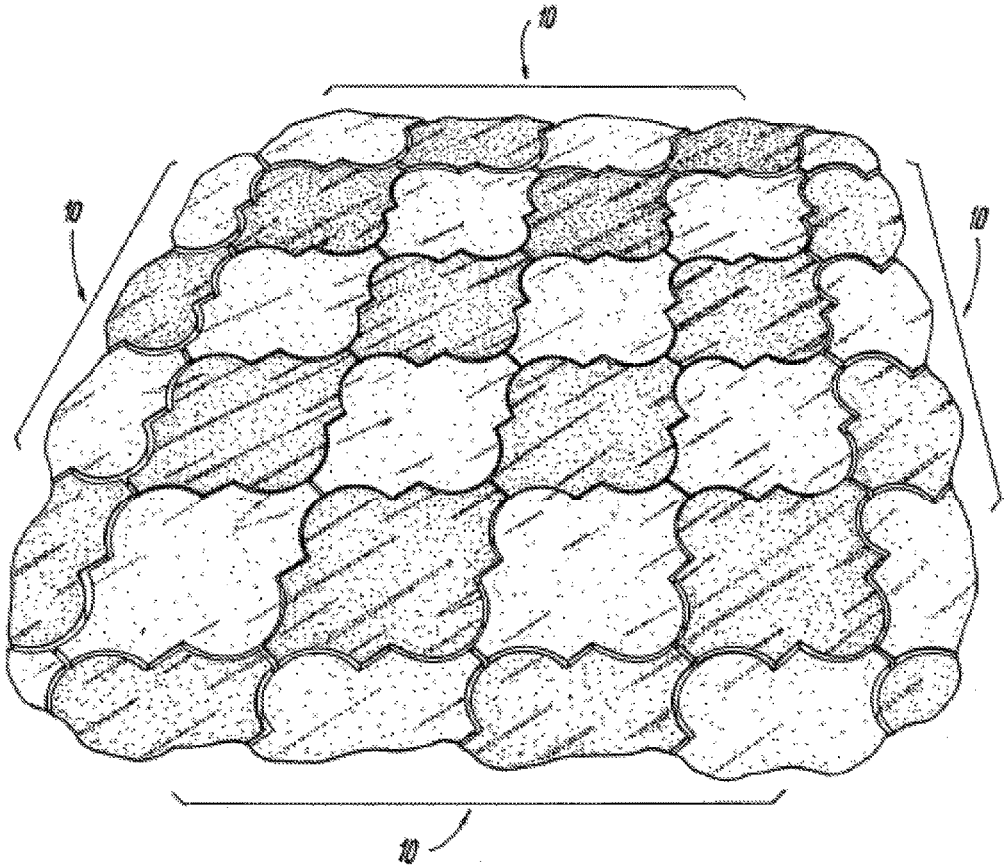
FIG. 8 is a simplified fragmentary perspective view of an array of mosaic tiles that have been positioned adjacent one another on a surface to cover the surface with mosaic tiles.

The mosaic tile 10 has relatively low density and light weight as compared to solid layer tiles or ceramic tiles, because the foam base layer 26 constitutes a substantial volume of the mosaic tile 10, and the mosaic tile 10 has approximately the same thickness as a ceramic tile of similar length and width. The mosaic tile 10 also has good impact resistance, good thermal insulation, and good acoustical insulation. The low density and lightweight characteristics of the mosaic tile 10 facilitate handling and installation, and are likely to have immense appeal to do-it-yourself individuals with little or no experience in tile installation The mosaic tile 10 can be assembled with other similar mosaic tiles 10 (FIGS. 7 and 8) on a surface 92, which can be a ceiling surface, a wall surface and a flow surface. Preferably, the surface onto which the tile is adhered should be clean and smooth. However, the flexible, resilient characteristics of the backing layer 60 enable the mosaic tile 10 to have substantial surface-to-surface contact with a wall surface, a ceiling surface or a floor surface that may not be perfectly planar or may have some surface imperfections.

The lightweight features of the mosaic tile 10 are advantageous for obtaining a secure bond when installing the mosaic tile 10 on a vertical wall surface or a horizontal ceiling surface because the self-stick adhesive bottom surface 64 of the mosaic tile 10 provides a substantially complete surface-to-surface contact on the wall surface and ceiling surface.

It is especially easy to install the mosaic tile 10 at vertical corners, such as inside corners of intersecting walls or at outside corners of intersecting walls, such as entry ways, since the mosaic tile member 10 can be easily cut to the desired size with an inexpensive cutting tool such as a box cutter.

Figure 9:
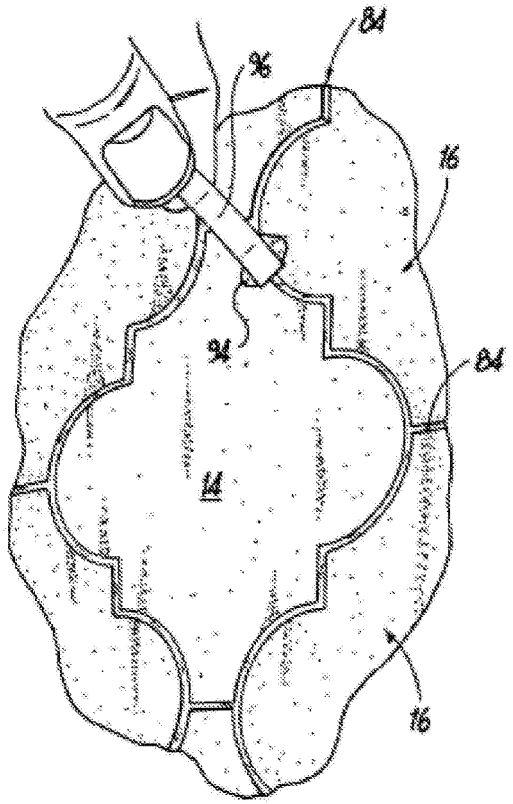
FIG. 9 is a simplified fragmentary view of a mosaic tile being grouted.

The grout spaces 84 (FIGS. 6 and 9) between individual tiles 14 and 16 of the mosaic tile 10, and the grout spaces 84 between adjacent mosaic tiles 10 that are installed on a surface 92 (FIG. 7) are grouted with a grout 94 (FIG. 9) in any suitable known manner, such as with a grouting tool 96 as shown in simplified form in FIG. 9. Other known methods of grouting can also be used. The grout 94 should preferably be a non-abrasive grout because an abrasive grout might abrade the plastic and foam components of the tiles 14 and 16.

Figure 10:
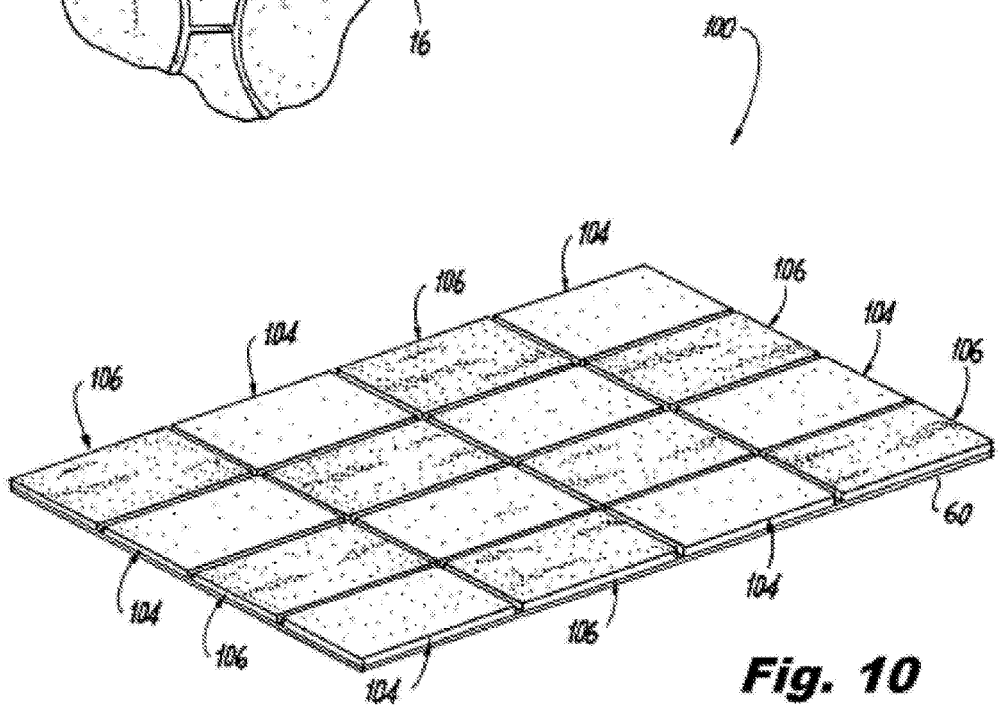
FIG. 10 is a simplified perspective view of a mosaic tile incorporating another embodiment of the invention.

A mosaic tile member incorporating another embodiment of the invention is generally indicated by the reference number 100 in FIG. 10.

The mosaic tile member 100 includes one set of individual, generally rectangular tiles 104 and another set of individual, generally rectangular tiles 106.

The tiles 104 and 106 include the same laminate constituents as previously described for the tiles 14 and 16, as shown in FIG. 3. Thus, each of the tiles 104 and 106 include the foam base layer 26, the design film layer 36, the wear layer 40, and optionally, the ceramic bead coating 42 (FIGS. 3 and 4).

Each of the tiles 104 in the first set of tiles have similar design appearances, and each of the tiles 106 in the second set of tiles have similar design appearances. However, the design appearance of the tiles 104 differs from the design appearance of the tiles 106. Thus, the set of individual tiles 104 and the set of individual tiles 106 are characterized by different designs.

The positioning of the individual tiles 104 and 106 in the mosaic tile member 100 onto the backing layer 60 (FIG. 10) is accomplished in a manner similar to the assembly process previously described for positioning the individual tiles 14 and 16 in the mosaic tile 10.

The sets of individual tiles 104 and 106, which can be of the same square or rectangular size, are positioned in the mosaic tile member 100 in a predetermined pattern to provide the mosaic tile member 100 with a predetermined mosaic appearance. For example, the mosaic tile member 100 can be arranged with the individual tiles 104 and 106 in alternating positions, and in aligned rows and columns as shown in FIG. 10.

Figure 11:
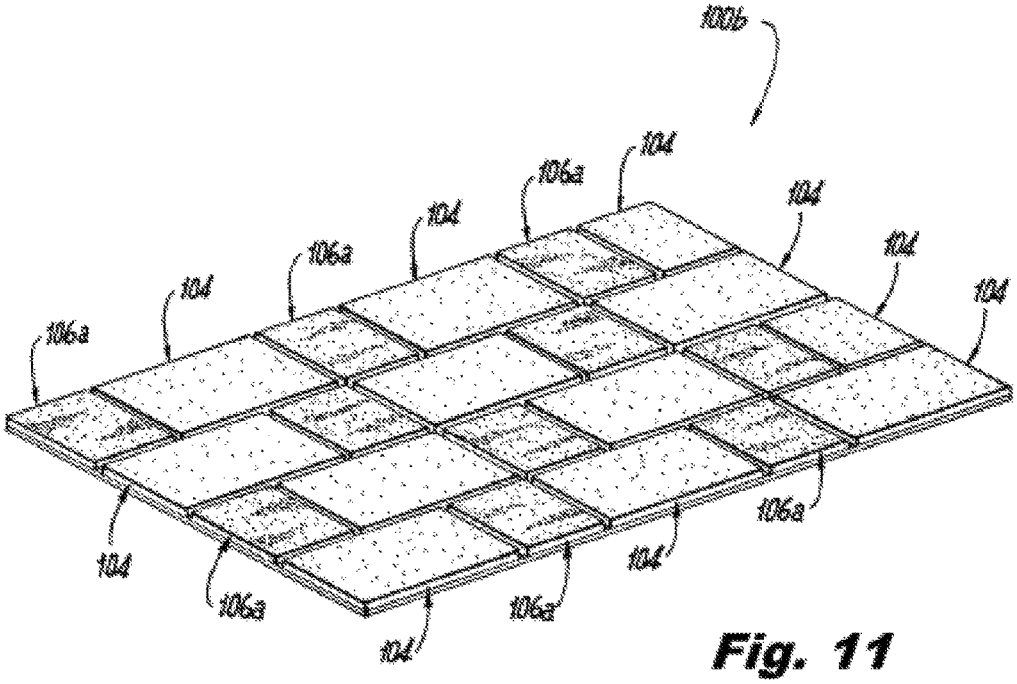
FIGS. 11 and 12 are simplified perspective views of a mosaic tile incorporating further embodiments of the invention; and, FIG. 13 is a simplified schematic perspective view of a cutting device for cutting individual tiles from a blank laminate sheet.
Figure 12:
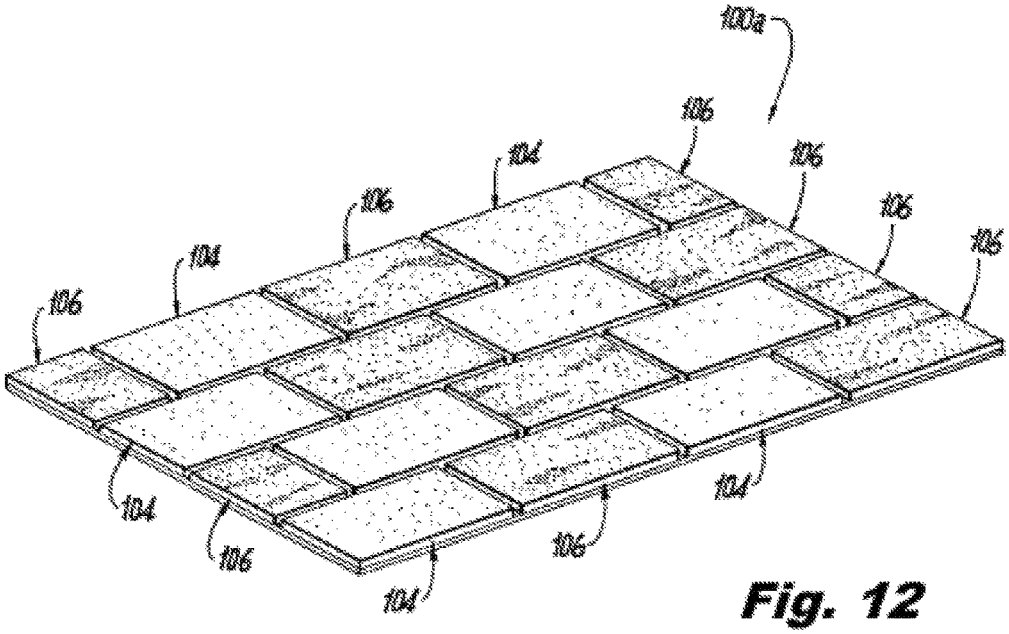

If desired, the individual tiles 104 and 106 of a mosaic tile 100*a* (FIG. 12) can be arranged in alternating positions, and in staggered rows and columns. Also, if desired, the individual tiles 104 and 106 can be of different rectangular sizes as shown by the tiles 104 and 106*a* in the mosaic tile 100*b* of FIG. 11. However, the tiles 104, 106, and 106*a* in the mosaic tiles 100*a* and 100*b* of FIGS. 11 and 12 have laminate components that correspond to the laminate components previously described for the tiles 14 and 16 of the mosaic tile 10.

Each of the individual tiles 104 and 106 can be die cut from a relatively large laminate blank sheet or web 110 (FIG. 13) having the laminate structure previously described for the tiles 104 or 106. A suitable cutting die 112 (FIG. 13), which is shown in simplified schematic form, can be used as a punching die or adapted in a rotary die (not shown) to punch out the individual tile 104 from the blank sheet 110.

The cutting die 112 includes cutting edges 114 and 116 that form a cutting periphery of complementary shape to the periphery of the tile 104. In accordance with known methodology the cutting die 112 can reciprocate or roll onto the blank laminate sheet 110 to cut and form the individual tiles 104. If desired, the blank laminate sheet 110 can also be arranged to move relative to the cutting die 112.

Figure 13:
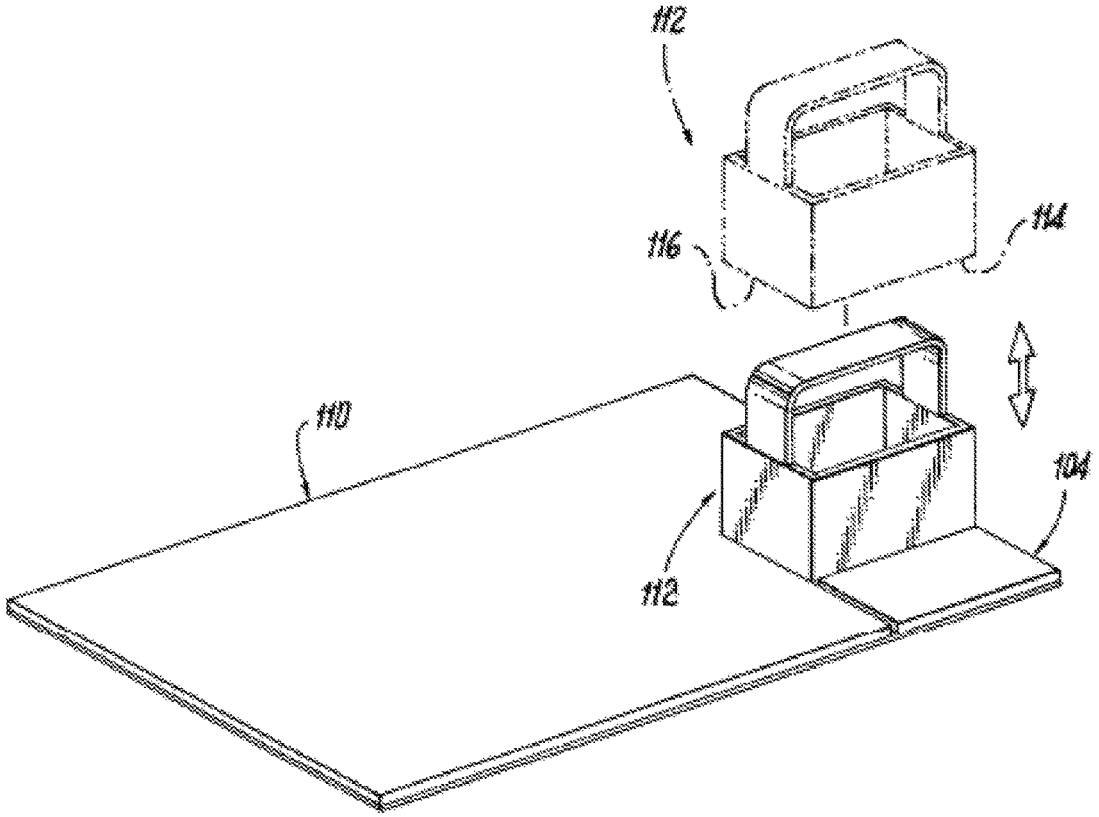

In similar fashion, a cutting die (not shown) having a cutting periphery that matches the periphery of the individual tiles 14 and 16 in the mosaic tile 10 (FIG. 1) can be used to cut the individual tiles 14 or 16 from a laminate blank sheet such as the sheet 110 (FIG. 13).

Whether the mosaic tile 100 has tiles 104 and 106 of equal size and shape, or of different sizes, an overall 12 inch by 12 inch size of the mosaic tile 100 or any other selected size can be provided. Furthermore, an overall laminate thickness of 4.5 millimeters for a 12 inch by 12 inch mosaic tile 100, having the same laminate components as previously described for the first embodiment of the mosaic tile 10, will result in a weight of the mosaic tile 100 of less than eight ounces. There should thus be relatively easy handling and installation of the mosaic tile 100 on a wall, ceiling and floor surface As various changes can be made in the above constructions and methods without departing from the scope of the invention, it is intended that all matter contained in the above description or shown in the accompanying drawings shall be interpreted as illustrative and not in a limiting sense.

What is claimed is:

1. A mosaic tile member comprising, a) a backing layer sheet having a top adhesive surface and a bottom surface, b) a predetermined plurality of individual tiles being adhered to the top adhesive surface of the backing layer sheet in spaced relationship to form the mosaic tile member and to permit grouting between adjacent ones of the individual tiles in the mosaic tile member, c) said mosaic tile member with the individual tiles has a predetermined periphery such that one said mosaic tile member with the individual tiles can be positioned on a wall surface, a ceiling surface and a floor surface, next to another, said mosaic tile member with the individual tiles in a spaced relationship to permit grouting between the peripheries of adjacent mosaic tile members, d) each said individual tile in the mosaic tile member has, (i) a foam base layer formed of closed cell foam, said foam base layer having an upper surface and a lower surface, (ii) a design layer having an upper surface with a design and a lower surface, the lower surface of the design layer being positioned onto the upper surface of the foam base layer, (iii) a transparent protective wear layer for protecting said design layer, said transparent protective wear layer having a top surface and said transparent protective wear layer is positioned onto the upper surface of said design layer such that the design of the design layer is visible through the top surface of the transparent protective wear layer, e) said mosaic tile member having a predetermined overall thickness from the bottom surface of the backing layer sheet to the top surface of the transparent protective wear layer, and said foam base layer constitutes 67% to 80% of the predetermined overall thickness of said mosaic tile member, f) and wherein the bottom surface of the backing layer sheet is an adhesive surface for securing the mosaic tile member with the predetermined plurality of individual tiles to a wall surface, a ceiling surface and a floor surface, whereby the same backing layer sheet that adheres all the individual tiles of the mosaic tile member to the top adhesive surface of the backing layer sheet is adapted to adhere, at the bottom surface of the backing layer sheet, all of the individual tiles of the mosaic tile member to a wall surface, a ceiling surface and a floor surface, g) the mosaic tile member including at least two different sets of the individual tiles, with each said different set of the individual tiles being characterized by different designs, and said different sets of the individual tiles are positioned on the top adhesive surface of the backing layer sheet in the mosaic tile member in a predetermined pattern to provide the mosaic tile member with a predetermined multi-design mosaic appearance, and, h) one of the two sets of the individual tiles is cut from a first laminate sheet having the foam base layer, the design layer having a first design, and the transparent protective wear layer, and a second of the two sets of individual tiles is cut from a second laminate sheet having the foam base layer, the design layer having a second design, and the transparent protective wear layer.

2. The mosaic tile member as claimed in claim 1 wherein the size of each of the tiles in the one set of individual tiles is different from the size of each of the individual tiles in the second set of individual tiles.

3. The mosaic tile member as claimed in claim 1, wherein the adhesive surface at the bottom surface of the backing layer sheet is a contact adhesive pre-coated onto the bottom surface of the backing layer sheet.

4. The mosaic tile member as claimed in claim 1 wherein the bottom surface of the foam base layer of each said individual tile in the mosaic tile member is in surface-to-surface contact with the top adhesive surface of the backing layer sheet to fix the position of each said individual tile in the mosaic tile member on the top adhesive surface of the backing layer sheet and maintain the grout space between adjacent ones of the individual tiles of the mosaic tile member.

5. The mosaic tile member as claimed in claim 1 wherein said individual tiles of the mosaic tile member are adhered to the top adhesive surface of the backing layer sheet in a predetermined pattern of rows and columns.

6. The mosaic tile member as claimed in claim 1 wherein said individual tiles of the mosaic tile member have a periphery with at least one curved peripheral portion.

7. The mosaic tile member as claimed in claim 1 wherein said individual tiles have a rectangular periphery.

8. The mosaic tile member as claimed in claim 1 wherein the individual tiles of the mosaic tile member that are adhered to the top adhesive surface of the backing layer sheet are each cut from a blank laminate of the foam base layer, the design layer, and the transparent protective wear layer.

9. The mosaic tile member as claimed in claim 1 wherein the foam base layer, the design film layer and the transparent protective wear layer are laminated together.

10. The mosaic tile member as claimed in claim 1, wherein the backing layer sheet is a double-sided adhesive sheet.

11. The mosaic tile member as claimed in claim 10, wherein the backing layer sheet is formed of a foam material.

12. A method of preparing a mosaic tile member for installation on walls, ceilings and floors comprising, a) providing a backing layer sheet with a top adhesive surface and a bottom surface, b) adhering a predetermined plurality of individual tiles to the top adhesive surface of the backing layer sheet in spaced relationship to form the mosaic tile member and to permit grouting between adjacent ones of the individual tiles in the mosaic tile member, c) providing the mosaic tile member with the individual tiles, with a predetermined periphery such that one said mosaic tile member with the individual tiles, can be positioned on a support surface next to another said mosaic tile member with the individual tiles, in a spaced relationship to permit grouting between the peripheries of adjacent mosaic tile members, d) forming each of the individual tiles in the mosaic tile member with, (i) a foam base layer formed of closed cell foam, wherein the foam base layer has an upper surface and a lower surface, (ii) a design layer and positioning the design layer onto the upper surface of the foam base layer, (iii) a transparent protective wear layer for protecting said design layer and positioning the transparent protective wear layer onto the design layer such that the design of the design layer is visible through the transparent protective wear layer, and e) forming the foam base layer with a thickness that is approximately 67% to 80% of the overall thickness of said mosaic tile member, wherein the overall thickness of the mosaic tile member is the thickness between the top of the transparent protective wear layer and the bottom of the backing layer, f) providing the backing layer sheet with a bottom adhesive surface for securing the mosaic tile member with the predetermined plurality of individual tiles to a wall surface, a ceiling surface and a floor surface, to enable the same backing layer sheet that adheres all the individual tiles of the mosaic tile member to the top adhesive surface of the backing layer sheet to adhere, at the bottom surface of the backing layer sheet, all of the individual tiles of the mosaic tile member to a wall surface, a ceiling surface and a floor surface, g) providing the mosaic tile member with at least two different sets of the individual tiles, with each said different set of the individual tiles being characterized by different designs, and positioning the different sets of the individual tiles on the top adhesive surface of the backing layer sheet in a predetermined pattern to provide the mosaic tile member with a predetermined multi-design mosaic appearance, and h) cutting one of the two sets of the individual tiles from a first laminate sheet having the foam base layer, the design layer having a first design, and the transparent protective wear layer, and cutting a second of the two sets of individual tiles from a second laminate sheet having the foam base layer, the design layer having a second design, and the transparent protective wear layer.

13. The method of claim 12 including cutting one set of the individual tiles from a first blank sheet of laminate of the foam base layer, the design layer having one of the different designs and the transparent protective wear layer, and cutting the other set of the individual tiles from a second blank sheet of laminate of the foam base layer, the design layer having the other of the different designs and the transparent protective wear layer.

14. The method of claim 13 including using a die or a cutting blade to cut the one and the other set of the individual tiles from the respective first and second blank sheets of laminate.

15. The method of claim 12 including adhering the individual tiles to the backing layer in a predetermined pattern of rows and columns.

16. The method of claim 12 including forming the individual tiles with a periphery having at least one curved peripheral portion.

17. The method of claim 12 including making the size of each of the tiles in the one set of individual tiles the same as or different from the size of each of the individual tiles in the second set of individual tiles.

18. The method of claim 12 including making the individual tiles with a rectangular periphery.

* * * * *